US006441733B1

(12) United States Patent
Unterschultz

(10) Patent No.: US 6,441,733 B1
(45) Date of Patent: Aug. 27, 2002

(54) METHOD FOR MAKING SECURITY SYSTEMS MORE TAMPER RESISTANT AND A SECURITY SYSTEM

(76) Inventor: David Darrell Unterschultz, 804 Richards Crescent, N.W., Edmonton, Alberta (CA), T6R 1B3

( * ) Notice: Subject to any disclaimer, the term of this patent is extended or adjusted under 35 U.S.C. 154(b) by 0 days.

(21) Appl. No.: 09/595,621

(22) Filed: Jun. 16, 2000

(51) Int. Cl.[7] ..... G08B 21/00

(52) U.S. Cl. ..... 340/540; 340/545.1; 340/545.2; 340/573.1; 340/573.4; 340/572.8; 340/660

(58) Field of Search ..... 340/540, 545.1, 340/547, 545.2, 573.4, 573.1, 572.1, 572.8, 572.9, 568.2, 568.4, 657, 660, 664, 652

(56) References Cited

U.S. PATENT DOCUMENTS 3,623,159 A * 11/1971 Bell ..... 340/533
4,310,835 A * 1/1982 Sefton ..... 340/533
4,518,953 A * 5/1985 Hunter et al. ..... 340/650
4,524,349 A 6/1985 Hyatt ..... 340/500
5,032,823 A * 7/1991 Bower et al. ..... 340/568
5,097,253 A * 3/1992 Eschbach et al. ..... 340/545
5,517,175 A * 5/1996 Brown et al. ..... 340/511

* cited by examiner

*Primary Examiner*—Jeffery Hofsass
*Assistant Examiner*—Daniel Prévil
(74) *Attorney, Agent, or Firm*—Christensen O'Connor Johnson Kindness PLLC

(57) ABSTRACT

A method for making a security system more tamper resistant involving the step of monitoring an electric reference characteristic in a detection circuit of a security system and generating random periodic changes to the electrical reference characteristic in order to detect any tampering with the electric reference characteristic in the detection circuit.

22 Claims, 2 Drawing Sheets

METHOD FOR MAKING SECURITY SYSTEMS MORE TAMPER RESISTANT AND A SECURITY SYSTEM

FIELD OF THE INVENTION

The present invention relates to a method for making security systems more tamper resistant and a security system configured in accordance with the teachings of the method.

BACKGROUND OF THE INVENTION

U.S. Pat. No. 4,310,835 (Sefton) teaches one skilled in the art to position an additional resistive device at the furthest extremity of each detection circuit. The purpose of this additional resistive device is to ensure that the detection circuit always contains some resistance which a control processor can monitor in order to detect tampering.

Security systems utilizing the teachings of Sefton remain vulnerable to tampering by criminals who are sufficiently sophisticated to test for in line resistance and jumper the wiring of the detection circuit with an appropriate resistance. The jumpering of the wires with a resistance equal to that of the additional resistive device fools the control processor into thinking that the detection circuit is still operational.

SUMMARY OF THE INVENTION

What is required is a method for making security systems more tamper resistant and a security system configured in accordance with the teachings of the method.

According to one aspect of the present invention there is provided a method for making a security system more tamper resistant. The method involves the step of monitoring an electric reference characteristic in a detection circuit of a security system and generating random periodic changes to the electrical reference characteristic in order to detect any tampering with the electric reference characteristic in the detection circuit.

In order to circumvent a security system, an output signal value must be ascertained in order to communicate that value back to the monitoring unit. With the method, as described above, the electric reference characteristic is randomly changed on a periodic basis. With the output value changing in a random manner, even security personnel responsible for installing and maintaining the security system are unable to predict the sequence of changing output values of the electric reference characteristic. The electric reference characteristic most commonly used in the industry is resistance which is measured as an output voltage. There are, however, other electric reference characteristics which could be monitored such as capacitance, impedance and inductance.

There are different ways in which the electric reference characteristics being monitored can be changed. Beneficial results have been obtained by providing a plurality of alternative line connections, each of which has a different electrical reference characteristic. Random periodic changes to the electrical reference characteristic are generated by connecting the detection circuit to a selected one of the plurality of alternative line connections to alter the electrical reference characteristic. The plurality of alternative line connections can be, but do not necessarily have to be positioned internally within a monitoring unit. In order to increase the number of alternative line connections, it may be desirable to position alternative line connections both internally within the monitoring unit and external to the monitoring unit.

According to another aspect of the present invention there is provided a security system which includes a control processor and at least one detection circuit monitored by the control processor. The detection circuit has at least one detector. Means is provided for generating random periodic changes to a monitored electrical reference characteristic in order to detect any tampering with the electric reference characteristic in the detection circuit. This feature can be incorporated into the existing control processor or included through the addition of a separate monitoring unit which checks for tampering.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
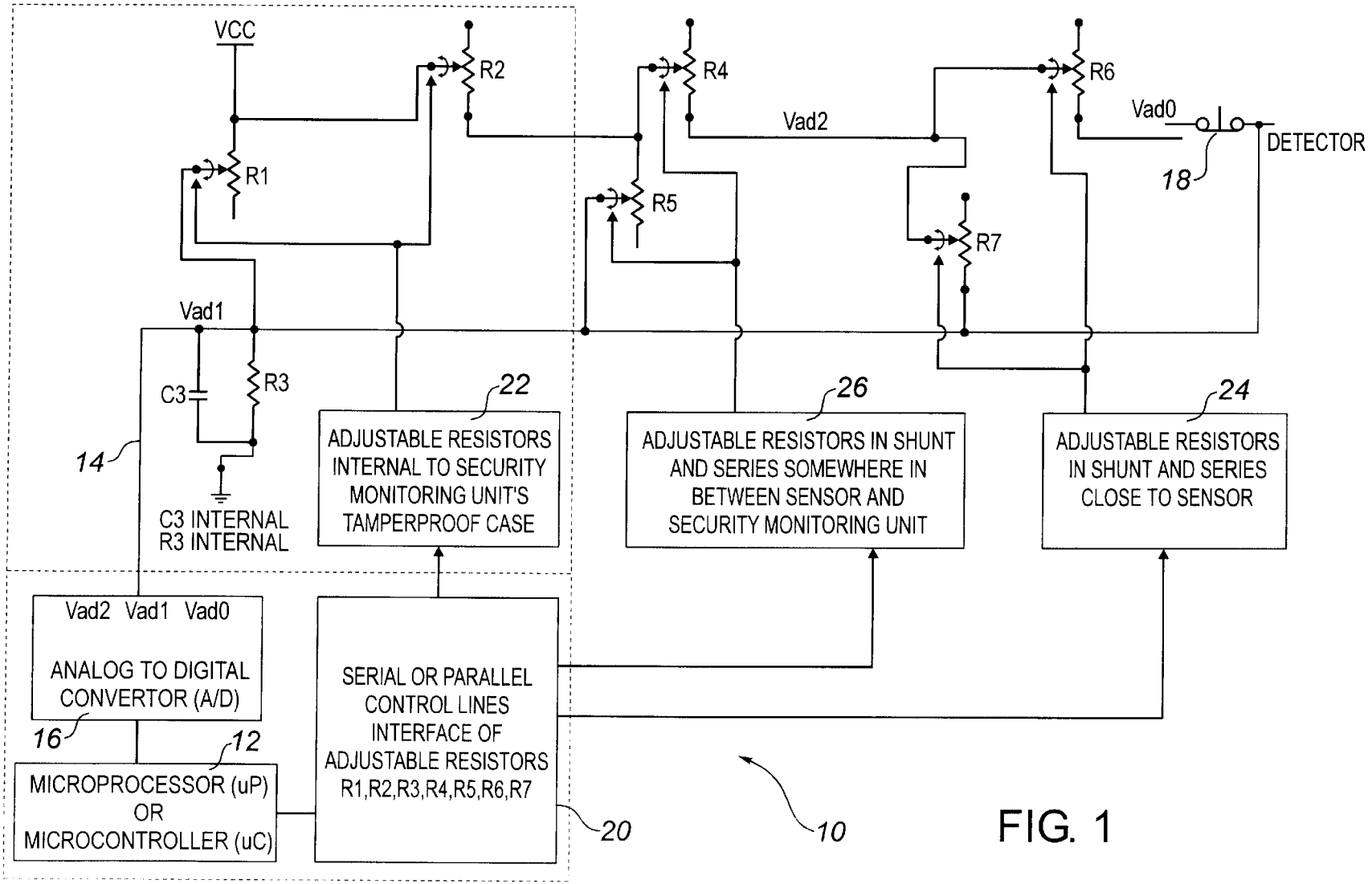
FIG. 1 is a block diagram of a security system with schematic elements illustrating how to configure the security system in accordance with the teachings of the present invention to make it more tamper resistant.

The preferred method for making security systems more tamper resistant will now be described with reference to FIGS. 1 and 2.

Referring to FIG. 11 the security system is generally identified by reference numeral 10. Security system 10 includes a processor 12 and one or more detection circuits 14 (only one of which is illustrated). Detection circuit 14 is monitored by control processor 12. The interface between 35 processor 12 and detection circuit 14 includes an analog to digital convertor 16. Each detection circuit 14 has at least one detector 18. Detector 18 can take a wide variety of forms. For example, it can be a motion detector, a smoke or heat sensor to detect fire or a proximity sensor to detect that a window or door is ajar. Processor 12 monitors an electric reference characteristic in detection circuit 14. The most common electrical reference characteristic is resistance, as measured by output voltage. In the embodiment illustrated in FIG. 1, resistance has been used as an example. There are, however, other electrical reference characteristics that can be and are monitored, such as capacitance, impedance and inductance. A combination of electrical reference characteristics can also be monitored, as will hereinafter be further described.

The method consists of unique step of generating random periodic changes to the electrical reference characteristic being monitored in order to detect any tampering with the electric reference characteristic in detection circuit 14. There are a variety of ways in which this can be done, in the example that will hereinafter be further described a plurality of adjustable resistors, collectively indicated by reference numeral 20, are positioned in detection circuit 14.

Figure 2:
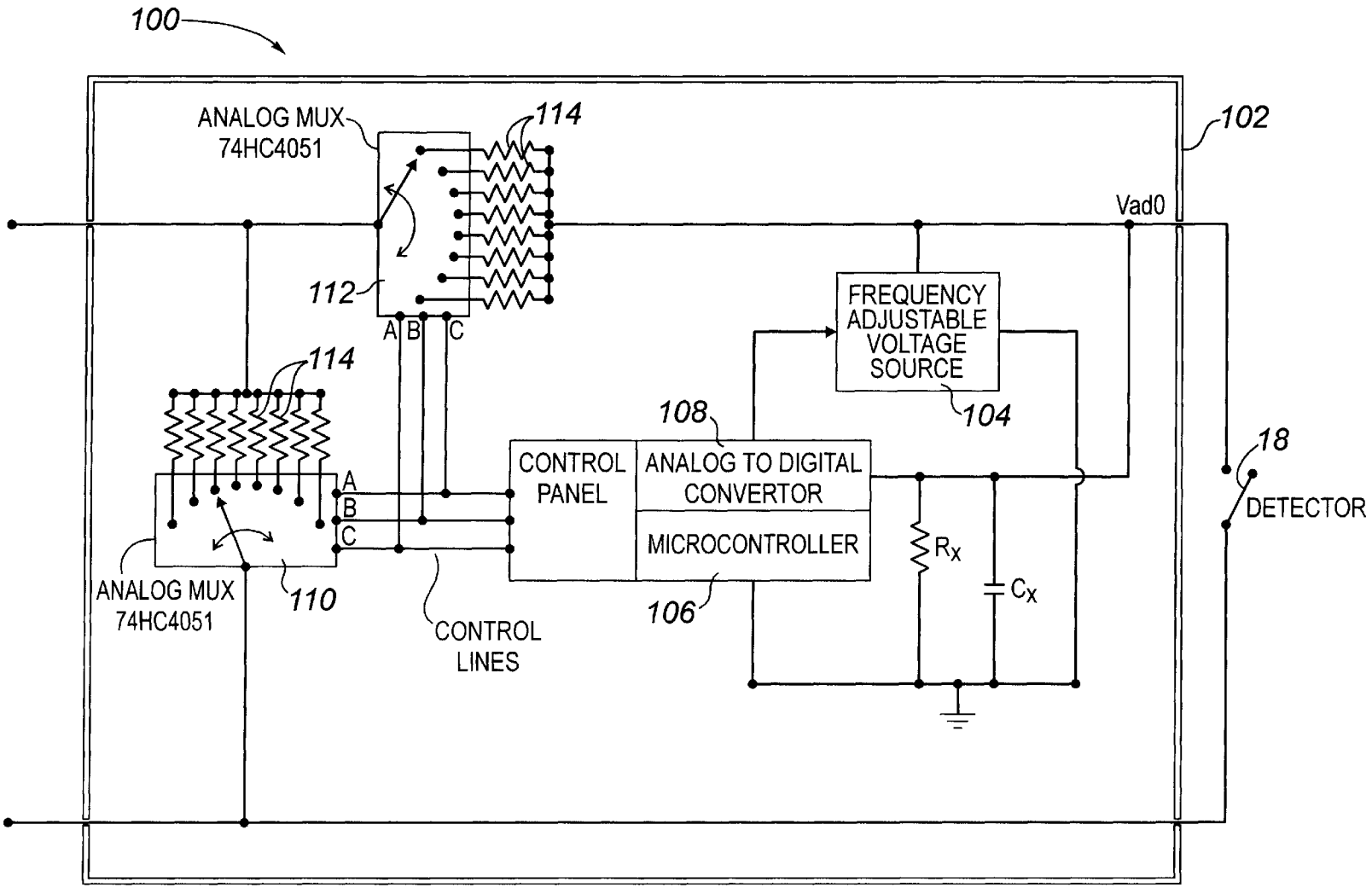
FIG. 2 is a block diagram of a security system with schematic elements illustrating how to configure a frequency response unit at each detector location in accordance with the teachings of the present invention to make it more tamper resistant.

Referring to FIG. 1, adjustable resistors 20 include three groupings positioned at different locations along detection circuit 14. Adjustable resistor grouping 22 is provided within a tamper proof housing. Adjustable resistor grouping 24 is positioned close to detector 18. Adjustable resistor grouping 26 is positioned at an intermediate location in detection circuit 14 between processor 12 and detector 18. As will hereafter be further described, each adjustable resistance includes both shunt and series resistances. Processor 12 monitors detection circuit 14 and makes random periodic changes to resistance through adjustable resistor groupings 22, 24, and 26 in order to detect any tampering with resistance in detection circuit 14.

Without the present invention, a detection circuit can be circumvented by a person who has a sufficient knowledge of alarm technology. This is accomplished by measuring resistance in the detection circuit with a resistance meter and jumpering the detection circuit with an appropriate resistance. The solution proposed is to have randomly generated changes in resistance. Upon a random change in resistance, a jumpering of the detection circuit using the former resistance becomes detectable.

It should be noted that each of adjustable resistance grouping 22, 24, and 26 has both Shunt and series resistances. Adjustable resistance grouping 22 has shunt resistor R1 and series resistor R2. Adjustable resistance grouping 26 has series resistor R4 and shunt resistor R5. Adjustable resistance grouping 24 has series resistor R6 and shunt resistor R7. With shunt and series resistances in the wiring one can not simply jumper a series resistance or jumper a shunt resistance without it being felt by the rest of the resistance circuit. Specifically, when one connects two equal value resistors in parallel, it halves the effective resistance of that part of the circuit. Now parallel resistors obey the rule of 1/Req=1/R1+1/R2+1/R3+. . . 1RN. When one connects two equal value resistors in series, it doubles the effective resistance of that part of the circuit. Series resistors obey the rules of R equivalent=R1+R2+R3+. . . RN. In this way, no matter how one jumpers the existing wiring, the effective resistance will either increase if connected in series or decrease if connected in parallel. Resistance is placed both ways to defeat tampering in both orientations. With a plurality of resistance in place in both orientations, jumpering in any orientation will result in both resistance increase in some parts of the circuit and resistance decreases in other parts of the circuit. The more interconnecting arrangements between resistors, the more interaction there is when the resistance of one of the resistors is randomly adjusted. A change in one part of the resistance circuitry interconnecting the voltage source to the Analog to Digital convertor will be felt throughout the circuit.

Since a resistance change in any one part of the circuit affects the voltages and current measurements in the rest of the circuit, the ability to monitor more than just the internal voltages will make the system further tamper resistant, such as Vad0 and Vad2. Beneficial results can be obtained when one adds to the system the potential to monitor a minimum of one point in the detection circuit to each of the detectors. All measured locations should correspond with the empirically measured values for the randomly adjusted resistance setting, in view of variance in wire lengths, connection conductivity, resistance quality variance and the like. The more measured points in the detection circuit, the more comparisons that can be made to ascertain if abnormalities of any kind exist. Once the details of the adjustable resistance systems becomes known, there will be attempts by the criminal element to develop "smart" jumpering systems. In order to avoid such "smart" jumpering systems, it is preferred that there be at least three adjustable resistance groupings 22, 24, and 26, as described above. Adjustable resistance grouping 22 will be positioned in a tamper proof housing within or near processor 12. Adjustable resistance grouping 24 will be positioned as close as possible to detector 18 and preferably in a tamper proof housing, as well. Adjustable resistance grouping 26 will be in an intermediate position between processor 12 and detector 18.

There are some adjustable resistors currently being manufactured that could be adapted for use with the security system described. A company called "MAXIM" is selling an adjustable potentiometer and adjustable two terminal variable resistor that is controlled by a three wire serial interface. The products are sold under the Trade Marks "MAX5160" and "MAX5161".

I envisage there being some additional steps in calibrating a security system such as described. The first step would involve the installation of the system with all detectors and adjustable resistance groupings. The second step would involve putting the system into an initialization and calibration mode prior to putting it into operation. In calibration mode, the security system measures the voltage output created for every possible random setting change in the adjustable resistor groupings. In it's memory, the system creates a table of measured voltage outputs for each possible adjustable resistor setting. The third step would involve putting the system into normal random operation. The security system knows what should be the correct expected voltage output for every possible combination of adjustable resistance settings.

Referring to FIG. 1, a filtering circuit is provided. R3 from the filtering circuit serves the purpose of creating a voltage drop and a voltage divider in conjunction with the adjustable resistors R1, R2, R4, R5, R6 and R7; that is between R3 and voltage source Vcc. R3 facilitates the measurement of voltage for the returning current. Vcc sources the current that flows to detector 18 and through shunt resistors R1, R5 and R7. All the current that is divided amongst these paths flows back to Analog to Digital convertor 16. Since Analog to Digital convertor 16 has high impedance, it only samples the voltage without drawing a lot of current into it. Most of the current flows down to ground through R3 creating a measurable voltage at that point. R3 also works in combination with capacitor C3 to filter out electrical noise and avoid false alarms. R3 also works with C3 to provide electrostatic discharges with a path to ground and helps protect the analog circuit from dangerously high current spikes the wiring may incur. R3 also works with C3 to create the correct settling time for the analog to digital convertor for the exponential decay of voltage changes to the correct DC voltage. R3 and C3 are preferably adjustable in nature as well.

Once the adjustable resistance concept is understood, it is possible to add onto that basic concept by sending a digital serial resistance setting control message from processor 12 through the very same wires that are used to interconnect it with detector 18. Detector 18 could send back to processor 12 voltage measurements of that part of detection circuit 14 that detector 18 is designed into. Bypass jumpering that part of the circuit would cut off communications with processor 12 to the adjustable resistor grouping 24 at detector 18. This would tell processor 12 immediately that a random change was not made since it would not receive feedback about the current voltage measurement and because the circuit's response would be incorrect for the latest random settings.

Although resistance has been selected as the electrical characteristic to illustrate in FIG. 1, once the teachings of the present invention are understood it will be appreciated that there are other electrical characteristics that could be randomly adjusted. For example, the frequency response of the electrical circuit interconnecting processor 12 with detector 18 can be monitored. It is preferred to measure the frequency response in both directions, as compared to current systems which only measure one end for voltage. Processor 12 would provide an alternating sine wave voltage source which is frequency adjustable and detector 18 would provide the same. By varying the frequency of a sine wave voltage source, a frequency varying sine wave voltage will be imposed on the circuit. This will create what can be termed a "frequency adjustable voltage sources". In such a system, the analog to digital convertor would measure the circuits voltage/current response for the current setting of resistors. When the frequency of the sine wave voltage source is changed through a range of frequencies, a frequency response can be measured for the detection circuit for that same frequency range. The frequency response for each different possible random resistance setting can be determined at empirical initialization and calibration mode set up and stored for future comparisons. It is preferred that the frequency response be measured in two or more locations of the detection circuit. A second voltage source with adjustable frequency is situated at the detector and controlled by the processor. Changes from the detector will be measured at all frequency response measurement locations for frequency response to random setting changes. Anyone tampering to bypass the detector will also cut off the second voltage response. This will result in no frequency responses. In this way the interconnecting circuitry's integrity is measured in both directions. All the aspects of random changes and respective measurement stay the same. Not only will an individual tampering with jumpering resistance anywhere in the detection circuit not know what the next random change will be, the individual will have no idea what the circuit's frequency response will be. Although adjustable resistance is a useful tool, frequency response is more complex as it is a unique measurement that measures the whole circuits response for resistance, capacitance and inductance. Even if an individual was sophisticated enough to "fool" the processor with an equivalent resistance, an equivalent resistance may not provide an appropriate frequency response. The masking of frequency response can be made even more difficult by the addition of adjustable capacitors. Referring to FIG. 2, there is illustrated a preferred form of frequency response unit, generally indicated by reference numeral 100. Frequency response unit 100 has a tamper proof housing 102. It is connected to detector 18. Positioned within frequency response unit 100 are a frequency adjustable voltage source 104, a microcontroller 106 which includes an analog to digital convertor 108. Changes in resistance are effected through the provision of two analog mux lip and 112 connected in shunt and series, respectively. Each analog mux 110 and 112 is connected to a plurality of resistors 114 having differing values. In operation, changes in resistance are made through either one or both of analog mux 110 and 112 and changes in frequency response are made through frequency adjustable voltage source 104.

The use of frequency response unit 100 provides a number of advantages. It affords multiple usage of the interconnecting detector wiring for both tamper detection and random changes in communications. This eliminates the need for separate serial communications wiring, while enhancing the security of the random change transmissions. It is intended that transmissions be broadcast throughout the security system to all units at once. Then on a separate polled schedule of each of frequency response units 100 to the monitoring unit, each frequency response unit 100 would report the current voltage reading at its location. The interception of the random change message does not tell the criminal which of the tamperproof resistor groupings is about to change. Each unit would have its own unique identification which enables it to determine if the message is for it to implement or to ignore.

It will be apparent to one skilled in the art that there are other electrical characteristics that could be varied to further increase the complexity to deter tampering. It also will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A method for making a security system more tamper resistant, the security system including a control processor and at least one detection circuit monitored by the control processor, the at least one detection circuit having at least one detector, the method comprising:

(a) monitoring at least one electrical reference characteristic selected from resistance, capacitance, impedance and inductance in the at least one detection circuit; and (b) generating random periodic changes to the at least one electrical reference characteristic in order to detect any tampering with the at least one electrical reference characteristic in the at least one detection circuit, said random periodic changes being generated internally by the security system.

2. The method as defined in claim 1, further including a step of monitoring a frequency response of the at least one detection circuit to at least one frequency adjustable voltage source.

3. The method as defined in claim 2, monitoring being undertaken of a frequency response of a first frequency adjustable voltage source originating from the processor and communicated to the detector and of a frequency response of a second frequency adjustable voltage source originating from the detector and communicated to the processor.

4. The method as defined in claim 1, the at least one electrical reference characteristic being resistance.

5. The method as defined in claim 1, the at least one electrical reference characteristic being both capacitance and resistance.

6. The method as defined in claim 4, there being a plurality of adjustable resistances including both shunt and series resistances.

7. The method as defined in claim 1, the at least one electrical reference characteristic being adjusted at more than one location in the at least one detection circuit.

8. The method as defined in claim 7, the at least one electrical reference characteristic being adjusted in a tamper proof security monitoring unit positioned remote from the at least one detector, in the at least one detection circuit close to the at least one detector and in an intermediate position between the security monitoring unit and the at least one detector.

9. A method for making a security system more tamper resistant, the security system including a control processor and at least one detection circuit monitored by the control processor, the at least one detection circuit having at least one detector, the method comprising:

(a) providing a plurality of adjustable resistances at several locations in the at least one detection circuit, each adjustable resistance including both shunt and series resistances;

(b) monitoring resistance in the at least one detection circuit; and (c) generating random periodic changes to resistance in at least one of the adjustable resistances in order to detect any tampering with resistance in the at least one detection circuit, said random periodic changes being generated internally by the security system.

10. The method as defined in claim 9, resistance being combined with at least one other electrical reference characteristic.

11. The method as defined in claim 10, the at least one other electrical reference characteristic being capacitance.

12. The method as defined in claim 9, further including a step of monitoring a frequency response of the at least one detection circuit to at least one frequency adjustable voltage source.

13. The method as defined in claim 12, monitoring being undertaken of a frequency response of a first frequency adjustable voltage source originating from the processor and communicated to the detector and of a frequency response of a second frequency adjustable voltage source originating from the detector and communicated to the processor.

14. The method as defined in claim 9, the resistance being adjusted at the following locations in the at least one detection circuit, namely: in a tamper proof security monitoring unit positioned remote from the at least one detector, in the at least one detection circuit close to the at least one detector and in an intermediate position between the security monitoring unit and the at least one detector.

15. A security system, comprising:

(a) a control processor;

(b) at least one detection circuit monitored by the control processor, the at least one detection circuit having at least one detector; and (c) one of the control processor and a monitoring unit configured to monitor at least one electrical, reference characteristic selected from resistance, capacitance, impedance and inductance in the at least one detection circuit and generate random periodic changes to the at least one electrical reference characteristic in order to detect any tampering with the at least one electrical reference characteristic in the at least one detection circuit.

16. The security system as defined in claim 15, wherein at least one frequency adjustable voltage source is provided, the control processor altering output frequency from the frequency adjustable voltage source and monitoring a frequency response of the at least one detection circuit to the at least one frequency adjustable voltage source.

17. The security system as defined in claim 16, monitoring being undertaken of a frequency response of a first frequency adjustable voltage source originating from the processor and communicated to the detector and of a frequency response of a second frequency adjustable voltage source originating from the detector and communicated to the processor.

18. The security system as defined in claim 15, wherein the at least one electrical reference characteristic is resistance.

19. The security system as defined in claim 18, wherein there is a plurality of adjustable resistances including both shunt and series resistances.

20. The security system as defined in claim 15, wherein the at least one electrical reference characteristic is both capacitance and resistance and series resistances.

21. The security system as defined in claim 15 wherein the at least one electrical reference characteristic is adjusted at more than one location in the at least one detection circuit.

22. The security system as defined in claim 21, wherein the at least one electrical reference characteristic being adjusted in the following locations in the at least one detection circuit, namely: in a tamper proof security monitoring unit positioned remote from the at least one detector, in the at least one detection circuit close to the at least one detector and in an intermediate position between the security monitoring unit and the at least one detector.

* * * * *

UNITED STATES PATENT AND TRADEMARK OFFICE

CERTIFICATE OF CORRECTION

PATENT NO. : 6,441,733 B1
DATED : August 27, 2002
INVENTOR(S) : D.D. Unterschultz It is certified that error appears in the above-identified patent and that said Letters Patent is hereby corrected as shown below:

Column 7,
Line 35, “electrical, reference” should read -- electrical reference --

Column 8,
Line 26, “resistance and series resistances.” should read -- resistance. --
Line 27, “claim 15” should read -- claim 15, --

Signed and Sealed this

Eleventh Day of February, 2003

JAMES E. ROGAN
*Director of the United States Patent and Trademark Office*